United States Patent [19]

Meyer

[11] 4,378,772

[45] Apr. 5, 1983

[54] OPEN LOOP ELECTRONIC CIRCUIT FOR ALTITUDE COMPENSATION

[75] Inventor: Paul M. Meyer, East Alton, Ill.

[73] Assignee: ACF Industries, Inc., New York, N.Y.

[21] Appl. No.: 278,298

[22] Filed: Jun. 26, 1981

[51] Int. Cl.[3] ..... F02M 7/12

[52] U.S. Cl. ..... 123/438

[58] Field of Search ..... 123/438, 585, 434, 440

[56] References Cited

U.S. PATENT DOCUMENTS

| | | | |
|---|---|---|---|
| 3,861,366 | 1/1975 | Masaki et al. | 123/438 |
| 3,912,796 | 10/1975 | Brown | 123/438 X |
| 4,187,814 | 2/1980 | Phelan et al. | 123/438 |
| 4,282,840 | 8/1981 | Yamada et al. | 123/438 X |
| 4,307,696 | 12/1981 | Noji et al. | 123/585 |

*Primary Examiner*—Tony M. Argenbright

*Attorney, Agent, or Firm*—J. Joseph Muller

[57] ABSTRACT

An open loop electronics circuit (1) for altitude compensation of a carburetor (C) installed on an internal combustion automobile engine (E). The carburetor has an associated solenoid (S) controlling auxiliary air bled into fuel circuits of the carburetor thereby to control the air-fuel ratio of the mixture produced by the carburetor. A bridge (7) continuously senses the density of air which varies as a function of altitude and generates an electrical signal Es the amplitude of which changes in response to changes in air density. A converter (13) is responsive to the electrical signal for generating a variable pulse width control signal Cs supplied to the solenoid. The converter (13) varys the pulse width of the control signal in response to amplitude changes in the electrical signal generated by the bridge circuit whereby the air-fuel ratio of the mixture produced by the carburetor is varied as a function of changes in air density.

2 Claims, 2 Drawing Figures

OPEN LOOP ELECTRONIC CIRCUIT FOR ALTITUDE COMPENSATION

BACKGROUND OF THE INVENTION

This invention relates to electronic circuits for use on internal combustion automobile engines, and more particularly an open loop electronics circuit for carburetor altitude compensation.

It is well known that changes in air density due, for example, to atmospheric pressure changes effect the operation of a carburetor installed on an automobile engine. Typically, such a change occurs when the vehicle is driven at an altitude other than that for which the carburetor is calibrated. Various schemes of altitude compensation have been tried from time to time to compensate for the effects of atmospheric pressure changes. Society of Automotive Engineers (SAE) paper 760286 describes the problem presented by atmospheric pressure changes and discusses a number of ways of coping with it. The proposed ways include both mechanical and electronic schemes. U.S. Pat. No. 3,899,551 issued Aug. 12, 1975, is an example of the former approach, while U.S. Pat. No. 4,237,833 issued Dec. 9, 1980, is an example of the latter. As shown in the 4,237,833 patent, it is a feature of the various electronic schemes that they include feedback circuitry employing microprocessors or similar devices in which numerous additional sensing features are included. While systems of this type may effectively compensate for atmospheric pressure changes, such systems are both complex and expensive. What is needed, is a simple circuit not requiring feedback or a multitude of associated sensors which is easily installed on a vehicle and readily interfaces with the carburetor to provide altitude compensation.

SUMMARY OF THE INVENTION

Among the several objects of the present invention may be noted the provision of an electronic circuit for altitude compensation for a carburetor installed on an automobile engine; the provision for such a circuit to be an open loop circuit and not requiring feedback, complex circuitry or a multitude of sensors; the provision of such an open loop circuit for readily interfacing with the carburetor to provide altitude compensation; and, the provision of such a circuit which is low in cost and easily installed on a vehicle in a convenient location so as not to interfere with other carburetor or engine operations.

Briefly, the present invention is for an open loop electronic circuit for altitude compensation of a carburetor installed on an internal combustion automobile engine. The carburetor has an associated solenoid controlling auxiliary air bled into fuel circuits of the carburetor thereby to control the air-fuel ratio of the mixture produced by the carburetor. A sensor continuously senses the density of air which varies as a function of altitude. The sensor generates an electrical signal the amplitude of which changes in response to changes in air density. Means are provided responsive to the electrical signal for generating a variable pulse width control signal which is supplied to the solenoid. This signal responsive means varies the pulse width of the control signal in response to amplitude changes in the electrical signal. This permits variation of the air-fuel ratio of the mixture produced by the carburetor as a function of changes in air density. Other objects and features will be in part apparent and in part pointed out here and after.

BRIEF DESCRIPTION OF THE DRAWINGS

Corresponding reference characters indicate corresponding parts in the two figures of drawings.

DESCRIPTION OF A PREFERRED EMBODIMENT

Figure 1:
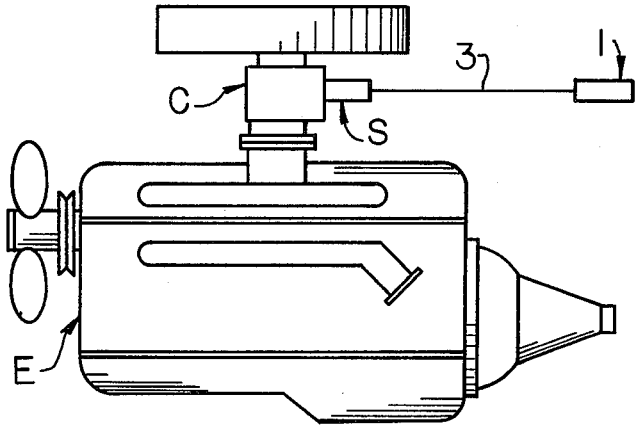
FIG. 1 illustrates an engine on which is mounted a carburetor and its associated solenoid, and an open loop electronic circuit of the present invention for providing altitude compensation to the carburetor; and, FIG. 2 is a schematic circuit diagram of the open loop circuit of the present invention for providing altitude compensation.

Referring to the drawings, an automobile engine E has a carburetor C mounted thereon. As is well known in the art, carburetor C mixes fuel and air to form a combustible mixture supplied to engine E. As is also well known in the art, auxiliary air is bled into the carburetor fuel circuits to control the quantity of fuel mixed with air at any one time thereby to control the air-fuel ratio of the mixture produced. The carburetor has an associated solenoid S energized to control the quantity of auxiliary air bled into the fuel circuits. As explained in Society of Automotive Engineers (SAE) paper 760286, the pressure and temperature conditions of the air drawn into carburetor C affects operation of the carburetor. To obtain the desired performance characteristics of carburetor C, it is therefore desirable to compensate for changes in altitude. For this purpose, an open loop electronics circuit 1 of the present invention is used to generate signals supplied to solenoid S over a lead wire 3 thereby to command solenoid S to admit more or less auxiliary air into the carburetor fuel circuits to change the air-fuel mixture produced by the carburetor.

Figure 2:
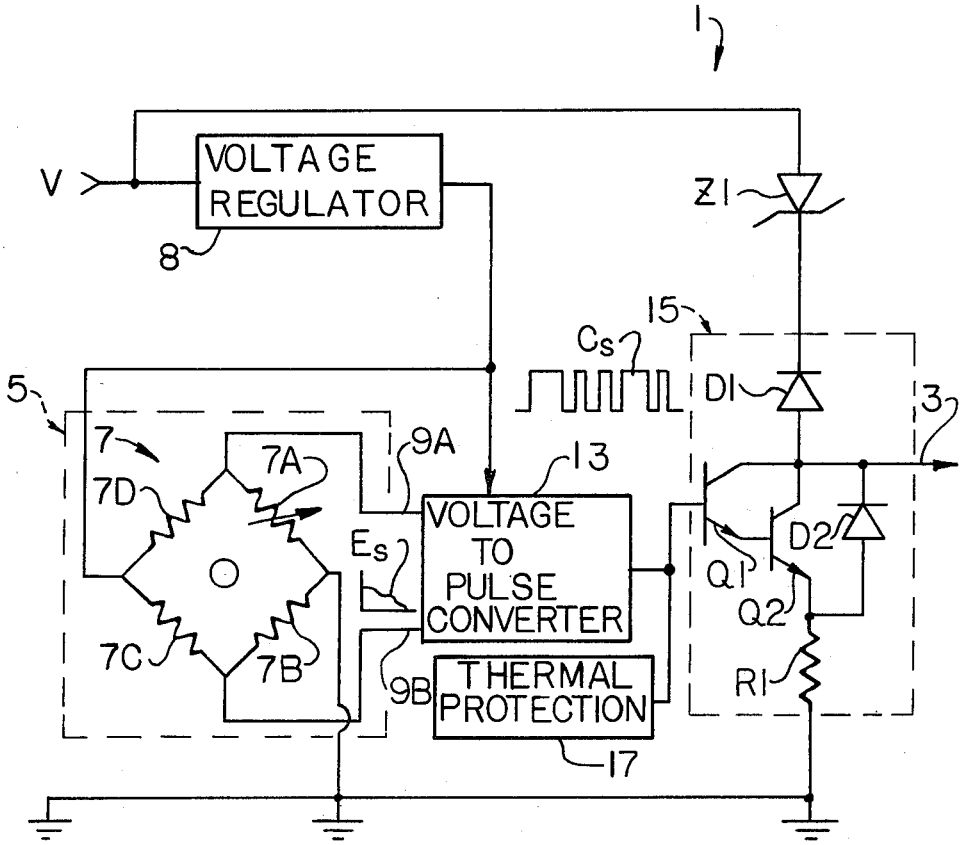

As shown in FIG. 2, open loop electronic circuit 1 includes a means 5 for continuously sensing density of air. Sensing means 5 comprises a bridge circuit 7 which is preferrably a strain gage bridge circuit. Voltage is supplied via a regulator 8 to the bridge circuit which has one or more variable resistance elements 7A–7D comprising the arms of the bridge circuit, only one such variable resistance element 7A being shown in FIG. 2. As the automobile in which circuit 1 is installed is driven to higher or lower altitudes, changes in air density will affect the resistance of the variable resistance elements comprising the various arms of the bridge circuit. This results in a variable voltage being developed across the bridge circuit and provided as an electrical signal Es over output lines **9*a* and 9*b***.

Circuit 1 further includes means 11 responsive to the electrical signal Es produced by strain gage 7 for generating a variable pulse width control signal Cs supplied to solenoid S. Means 11 includes a voltage-to-pulse converter 13 which is also supplied regulated power from voltage regulator 8. Bridge circuit output lines **9*a* and 9*b* are connected to the input of voltage-to-pulse converter 13 to provide electrical signal Es from the strain gage bridge circuit 7 as an input to the converter. Converter 13** operates as is well known in the art to generate variable pulse width control signal Cs, the pulse width of the signal varying in response to amplitude changes in the input wave form supplied to the converter. As a consequence, changes in air density are transformed into a control signal having an output waveform consisting of a series of pulses the width of which is changed in response to increasing or decreasing altitude and changes in air temperature.

Circuit 1 further includes a driver circuit 15 interposed between voltage-to-pulse converter 13 and solenoid S. Driver circuit 15 comprises of a pair of PNP transistors Q1 and Q2 respectively. The output waveform of converter 13 is applied to the base of transistor Q1, the emitter of this transistor being connected to the base of transistor Q2. The emitter of transistor Q2 is connected to ground via a resistor R1. The collectors of transistors Q1 and Q2 are tied together and are connected to line 3 by which the control signal is supplied to solenoid S. A zener diode Z1 controls the voltage level supplied to the junction point of the transistor collectors via a diode D1. A diode D2 is connected between the emitter and collector of transistor Q2. Operation of driver 15 is such as to provide a control signal Cs to solenoid S which is compatible with the solenoid so as to operate the solenoid to increase or decrease the quantity of auxiliary air admitted to the fuel circuits of carburetor C in accordance with the changes in air density sensed by strain gage bridge 7.

Electronic circuit 1 operates in the frequency range of from 10 to 100 Hz. Voltage-to-pulse converter 13 is calibrated to, for example, have an output waveform with a zero percent duty cycle at sea level, this duty cycle increasing to some predetermined value at a preselected maximum altitude. The circuit is easily mounted on the fire wall of the vehicle or in some other convenient location in the engine compartment and readily interfaces with carburetor C via line 3 and solenoid S.

Lastly, open loop electronics circuit 1 includes thermal protection circuitry indicated generally 17. Thermal protection circuit 17 varies the pulse width of the control signal applied to solenoid S so to affect the air-fuel ratio of the mixture produced by carburetor C when engine is operating under colder temperature conditions than that for which electronics circuit 1 is otherwise calibrated. Thus, thermal protection circuit 17 may decrease the pulse width of the control signal supplied to solenoid S if it is colder at altitude than electronics circuit 1 is calibrated for. This results in a slightly richer air-fuel ratio than would otherwise be produced. This in turn would make it easier to start and operate engine E.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. An open loop electronic circuit for altitude compensation of a carburetor installed on an internal combustion engine, the carburetor having an associated solenoid controlling auxiliary air bled into the fuel circuits of the carburetor thereby to control the air-fuel ratio of the mixture produced by the carburetor, the circuit comprising a bridge circuit having a variable resistant element which includes a strain gage the resistance of which changes as a function of altitude, the bridge circuit producing an electrical signal the amplitude of which changes in response to changes in air density; means responsive to the electrical signal for generating a variable pulse width control signal which is supplied to the solenoid, the signal response means operating in the range of 10–100 Hz and varying the pulse width of the control signal in response to amplitude changes in the electrical signal, the signal responsive means being calibrated to generate a control signal having a zero percent duty cycle at sea level and an increasing duty cycle at increasing altitude above sea level; and, thermal responsive means connected to the output of the signal responsive means, the thermal responsive means changing the pulse width of the control signal produced by the signal responsive means if the engine is operating at colder temperature conditions than for which the circuit is otherwise calibrated, the thermal responsive means affecting the control signal for the carburetor to produce a richer air-fuel mixture than what otherwise be produced thereby making it easier to start and operate the engine.

2. The circuit of claim 1 further including a driver circuit interposed between the signal responsive means and the solenoid.

* * * * *